US011545063B2

(12) United States Patent
Pyun et al.

(10) Patent No.: US 11,545,063 B2
(45) Date of Patent: Jan. 3, 2023

(54) DATA TRANSMISSION CIRCUIT AND DISPLAY APPARATUS INCLUDING THE SAME

(71) Applicant: SAMSUNG DISPLAY CO., LTD., Yongin-si (KR)

(72) Inventors: Kihyun Pyun, Gwangmyeong-si (KR); Heesook Park, Suwon-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/388,808

(22) Filed: Jul. 29, 2021

(65) Prior Publication Data

US 2022/0044609 A1 Feb. 10, 2022

(30) Foreign Application Priority Data

Aug. 4, 2020 (KR) ..... 10-2020-0097450

(51) Int. Cl.

*G09G 3/30* (2006.01)
*G09G 3/36* (2006.01)
*G09G 3/20* (2006.01)

(52) U.S. Cl.

CPC ..... *G09G 3/20* (2013.01); *G09G 2310/0267* (2013.01); *G09G 2310/0275* (2013.01); *G09G 2370/08* (2013.01)

(58) Field of Classification Search

CPC ..... G09G 3/20; G09G 2310/0275; G09G 2370/08; G09G 2370/14

See application file for complete search history.

(56) References Cited

U.S. PATENT DOCUMENTS

2013/0128994 A1* 5/2013 Hollis ..... H04B 15/00 375/259
2013/0223293 A1* 8/2013 Jones ..... H04L 5/14 370/276
2015/0325200 A1* 11/2015 Rho ..... G09G 3/3688 345/212

FOREIGN PATENT DOCUMENTS

KR 10-1813129 12/2017
KR 10-2020-0000008 1/2020
KR 10-2099819 4/2020

* cited by examiner

*Primary Examiner* — Sanghyuk Park
(74) *Attorney, Agent, or Firm* — F. Chau & Associates, LLC

(57) ABSTRACT

A data transmission circuit includes a transmitter configured to transmit a data signal, a receiver configured to receive the data signal, a first transmission line connected between the transmitter and the receiver, and a second transmission line connected between the transmitter and the receiver. The data signal includes a line start signal, and a configuration signal. The data signal further includes at least one of an inverted line start signal which is an inverted version of the line start signal or an inverted configuration signal which is an inverted version of the configuration signal.

20 Claims, 9 Drawing Sheets

DATA TRANSMISSION CIRCUIT AND DISPLAY APPARATUS INCLUDING THE SAME

CROSS-REFERENCE

This application claims priority under 35 U.S.C. § 119 to Korean Patent Application No. 10-2020-0097450, filed on Aug. 4, 2020 in the Korean Intellectual Property Office KIPO, the content of which is herein incorporated by reference in its entirety.

FIELD

The present inventive concept relates to data transmission circuits and display apparatuses. More particularly, embodiments of the present inventive concept relate to a data transmission circuit inserting an inverted version of at least one of a line start signal or a configuration signal to stabilize an input common mode voltage and a display apparatus including the data transmission circuit.

DISCUSSION OF RELATED ART

Generally, a display apparatus includes a display panel and a display panel driver. The display panel includes a plurality of gate lines and a plurality of data lines. The display panel driver includes a gate driver, a data driver and a driving controller. The gate driver outputs gate signals to the gate lines. The data driver outputs data voltages to the data lines. The driving controller controls the gate driver and the data driver.

The display panel driver may include a data transmission circuit to transmit data. The data transmission circuit may have a data transmitting interface type. The data transmission circuit may include a transmitter and a receiver. The transmitter and the receiver may transmit and receive a data signal based on an input common mode voltage.

When a ratio of a high signal of the data signal is great among the high signal and a low signal of the data signal, the input common mode voltage may increase compared to an ideal value. In contrast, when a ratio of the low signal of the data signal is great among the high signal and the low signal of the data signal, the input common mode voltage may decrease compared to the ideal value.

When the input common mode voltage increases compared to the ideal value, a circuit of the receiver might be damaged. When the input common mode voltage decreases compared to the ideal value, an error might occur in the signal received from the receiver and the signal transmission quality might deteriorate.

SUMMARY

Embodiments of the present inventive concept provide a data transmission circuit capable of stabilizing an input common mode voltage of the data transmission circuit.

Embodiments of the present inventive concept provide a display apparatus including the data transmission circuit.

In an embodiment of a data transmission circuit according to the present inventive concept, the data transmission circuit includes a transmitter configured to transmit a data signal, a receiver configured to receive the data signal, a first transmission line connected between the transmitter and the receiver and a second transmission line connected between the transmitter and the receiver. The data signal includes a line start signal, and a configuration signal. The data signal further includes at least one of an inverted line start signal which is an inverted version of the line start signal or an inverted configuration signal which is an inverted version of the configuration signal.

In an embodiment, the data signal further includes a pixel signal and a horizontal blank signal.

In an embodiment, the data signal may sequentially include the line start signal, the configuration signal, a first inversion signal, the inverted line start signal, the inverted configuration signal, and a second inversion signal.

In an embodiment, the transmitter may be configured to further transmit an inversion detection signal to the receiver. The inversion detection signal may be changed from a first level to a second level overlapping with the first inversion signal and changed from the second level to the first level overlapping with the second inversion signal.

In an embodiment, the first inversion signal and the second inversion signal may include a signal pattern substantially the same as the horizontal blank signal.

In an embodiment, the data signal may sequentially include the line start signal, a first inversion signal, the inverted line start signal, a second inversion signal, the configuration signal, a third inversion signal, the inverted configuration signal, and a fourth inversion signal.

In an embodiment, the transmitter may be configured to further transmit an inversion detection signal to the receiver. The inversion detection signal may be changed from a first level to a second level overlapping with the first inversion signal, changed from the second level to the first level overlapping with the second inversion signal, changed from the first level to the second level overlapping with the third inversion signal, and changed from the second level to the first level overlapping with the fourth inversion signal.

In an embodiment, the first inversion signal, the second inversion signal, the third inversion signal and the fourth inversion signal may include a signal pattern substantially the same as the horizontal blank signal.

In an embodiment, the data signal may include one of the inverted line start signal or the inverted configuration signal according to data patterns of the line start signal or the configuration signal, respectively.

In an embodiment, when a ratio between a high level and a low level of the line start signal is not 1:1, the data signal may include the inverted line start signal.

In an embodiment, when a ratio between a high level and a low level of the configuration signal is not 1:1, the data signal may include the inverted configuration signal.

In an embodiment, the configuration signal may include a first configuration signal and a second configuration signal. The inverted configuration signal may include a first inverted configuration signal which is an inverted version of the first configuration signal and a second inverted configuration signal which is an inverted version of the second configuration signal. The data signal may sequentially include the line start signal, a first inversion signal, the inverted line start signal, a second inversion signal, the first configuration signal, a third inversion signal, the first inverted configuration signal, a fourth inversion signal, the second configuration signal, a fifth inversion signal, the second inverted configuration signal, and a sixth inversion signal.

In an embodiment, the transmitter may be configured to further transmit an inversion detection signal to the receiver. The inversion detection signal may be changed from a first level to a second level overlapping with the first inversion signal, changed from the second level to the first level overlapping with the second inversion signal, changed from the first level to the second level overlapping with the third inversion signal, changed from the second level to the first level overlapping with the fourth inversion signal, changed from the first level to the second level overlapping with the fifth inversion signal and changed from the second level to the first level overlapping with the sixth inversion signal.

In an embodiment, the first inversion signal, the second inversion signal, the third inversion signal, the fourth inversion signal, the fifth inversion signal and the sixth inversion signal may include a signal pattern substantially the same as the horizontal blank signal.

In an embodiment, the configuration signal may include a first configuration signal and a second configuration signal. The data signal may include one of a first inverted configuration signal which is an inverted version of the first configuration signal or a second inverted configuration signal which is an inverted version of the second configuration signal according to data patterns of the first configuration signal or the second configuration signal, respectively.

In an embodiment, when a ratio between a high level and a low level of the first configuration signal is not 1:1, the data signal may sequentially include the line start signal, a first inversion signal, the inverted line start signal, a second inversion signal, the first configuration signal, a third inversion signal, the first inverted configuration signal, a fourth inversion signal, and the second configuration signal.

In an embodiment, when a ratio between a high level and a low level of the second configuration signal is not 1:1, the data signal may sequentially include the line start signal, a first inversion signal, the inverted line start signal, a second inversion signal, the first configuration signal, the second configuration signal, a third inversion signal, the second inverted configuration signal, and a fourth inversion signal.

In an embodiment, the data transmission circuit may further include a first capacitor disposed between the transmitter and the first transmission line, a second capacitor disposed between the receiver and the first transmission line, a third capacitor disposed between the transmitter and the second transmission line, and a fourth capacitor disposed between the receiver and the second transmission line.

In an embodiment of a display apparatus according to the present inventive concept, the display apparatus includes a display panel, a driving controller, a data driver and a data transmission circuit. The display panel is configured to display an image based on a data signal. The driving controller is configured to generate the data signal based on input image data. The data driver is configured to convert the data signal to a data voltage and output the data voltage to the display panel. The data transmission circuit includes a transmitter configured to transmit a signal, a receiver configured to receive the signal, a first transmission line connected between the transmitter and the receiver and a second transmission line connected between the transmitter and the receiver. The data signal includes a line start signal, a configuration signal, a pixel signal and a horizontal blank signal. The data signal further includes at least one of an inverted line start signal which is an inverted version of the line start signal or an inverted configuration signal which is an inverted version of the configuration signal.

In an embodiment, the data signal may sequentially include the line start signal, the configuration signal, a first inversion signal, the inverted line start signal, the inverted configuration signal, and a second inversion signal.

In an embodiment, the transmitter may be configured to further transmit an inversion detection signal to the receiver. The inversion detection signal may be changed from a first level to a second level overlapping with the first inversion signal and changed from the second level to the first level overlapping with the second inversion signal.

According to the data transmission circuit and the display apparatus, the inverted version of at least one of the line start signal and the configuration signal may be inserted so that the ratio between the high signal and the low signal of the data signal transmitted by the data transmission circuit may be actively controlled. Thus, the input common mode voltage of the data transmission circuit may be maintained in a target range.

Since the input common mode voltage is maintained in the target range, the circuit of the receiver need not be damaged and the error need not occur in the signal received from the receiver, and the signal transmission quality need not deteriorate.

Therefore, the stability and the reliability of the data transmission circuit and the display apparatus may be enhanced.

BRIEF DESCRIPTION OF THE DRAWINGS

The above and other embodiments of the present inventive concept will become more apparent by considering detailed descriptions thereof with reference to the accompanying drawings, in which.

DETAILED DESCRIPTION

Hereinafter, embodiments of the present inventive concept will be explained in detail with reference to the accompanying drawings.

Figure 1:
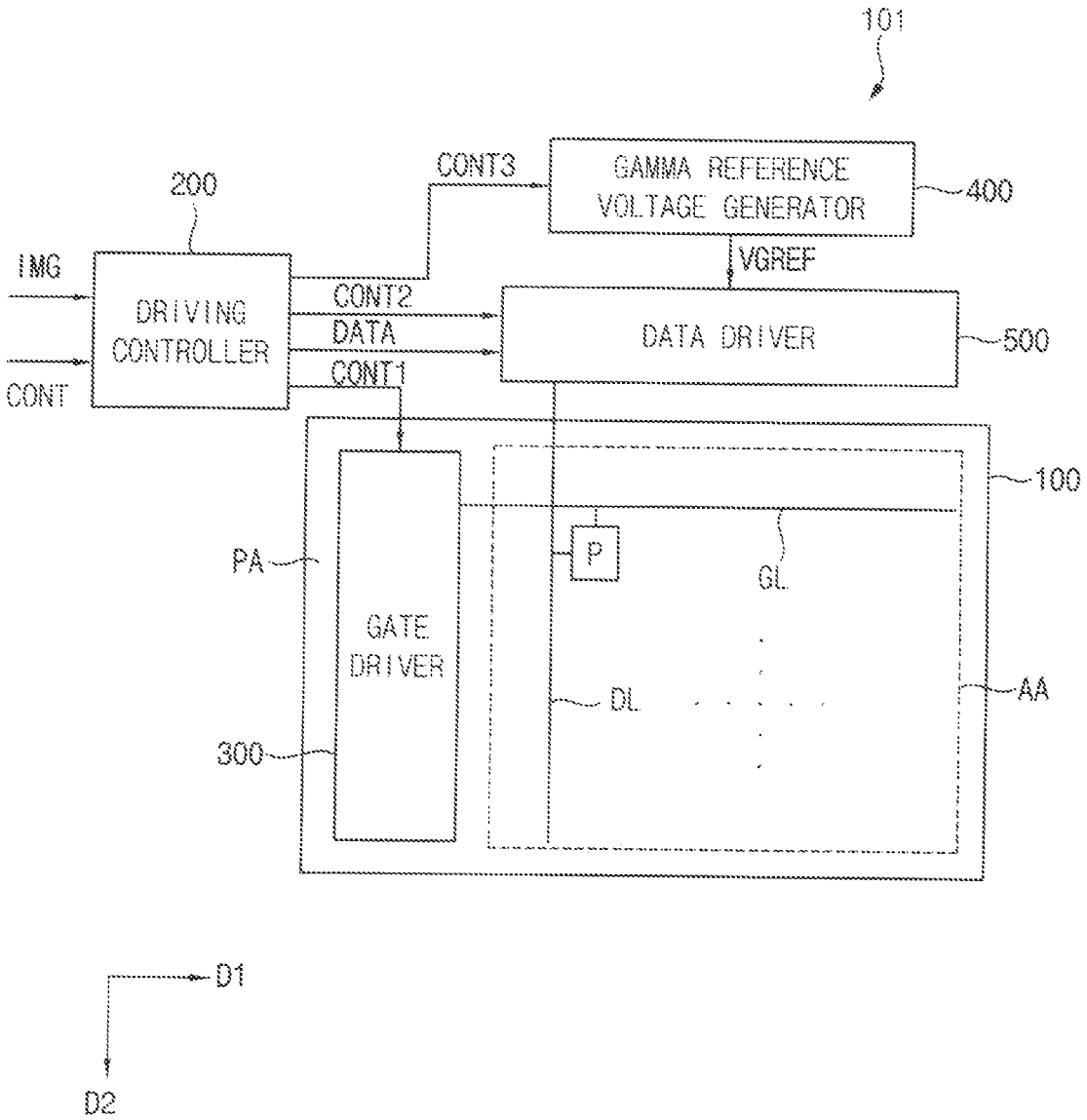
FIG. 1 is a block diagram illustrating a display apparatus according to an embodiment of the present inventive concept.

FIG. 1 is a block diagram illustrating a display apparatus 101 according to an embodiment of the present inventive concept.

Referring to FIG. 1, the display apparatus 101 includes a display panel 100 and a display panel driver. The display panel driver includes a driving controller 200, a gate driver 300, a gamma reference voltage generator 400, and a data driver 500. One or more of the driving controller 200, the gate driver 300, the gamma reference voltage generator 400, and/or the data driver 500 may be integrally formed and/or formed together with the display panel.

For example, the display panel 100 may include the gate driver 300. For example, the driving controller 200 and the data driver 500 may be integrally formed. For example, the driving controller 200, the gamma reference voltage generator 400 and the data driver 500 may be integrally formed. A driving module including at least the driving controller 200 and the data driver 500 which are integrally formed may be called a timing controller embedded data driver (TED).

The display panel 100 has a display region AA on which an image is displayed and a peripheral region PA adjacent to the display region AA.

The display panel 100 includes a plurality of gate lines GL, a plurality of data lines DL and a plurality of pixels P connected to the gate lines GL and the data lines DL. The gate lines GL extend in a first direction D1 and the data lines DL extend in a second direction D2 crossing the first direction D1.

The driving controller 200 receives input image data IMG and an input control signal CONT from an external apparatus. The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL. For example, the gate driver 300 may be mounted on the peripheral region PA of the display panel 100. For example, the gate driver 300 may be integrated on the peripheral region PA of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

Figure 2:
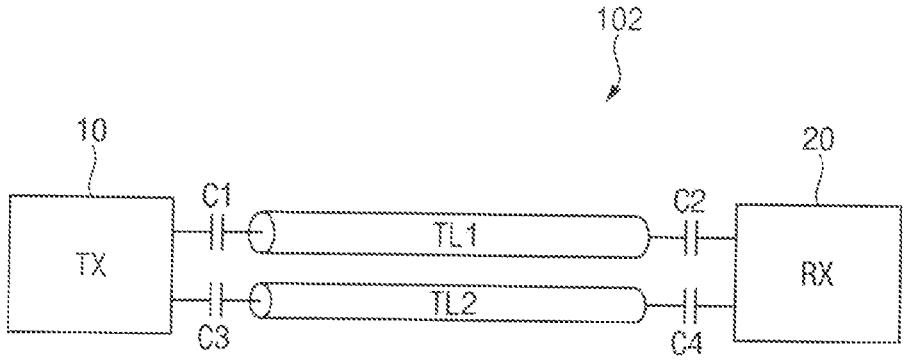
FIG. 2 is a circuit diagram illustrating a data transmission circuit of a display apparatus of FIG. 1.

FIG. 2 is a circuit diagram illustrating a data transmission circuit 102 of a display apparatus 101 of FIG. 1.

Referring to FIGS. 1 and 2, the display apparatus 101 includes the data transmission circuit 102. The data transmission circuit 102 includes a transmitter (TX) 10 transmitting the data signal DATA and a receiver (RX) 20 receiving the data signal DATA.

For example, the transmitter 10 may be included in the driving controller 200. The receiver 20 may be included in the data driver 500.

The data transmission circuit includes a first transmission line TL1 connected between the transmitter 10 and the receiver 20 and a second transmission line TL2 connected between the transmitter 10 and the receiver 20. For example, the first transmission line TL1 and the second transmission line TL2 may transmit the data signal DATA in a differential mode. The first transmission line TL1 may be a positive signal transmitting line. The second transmission line TL2 may be a negative signal transmitting line.

For example, the data transmission circuit may further include a first capacitor C1 disposed between the transmitter 10 and the first transmission line TL1 and a second capacitor C2 disposed between the receiver 20 and the first transmission line TL1, a third capacitor C3 disposed between the transmitter 10 and the second transmission line TL2 and a fourth capacitor C4 disposed between the receiver 20 and the second transmission line TL2.

The data transmission circuit may include the first to fourth capacitors C1, C2, C3 and C4 to operate AC coupling of the data signal DATA. When the AC coupling is operated, a DC component of the data signal DATA is removed so that the transmission stability of the data signal DATA may be enhanced.

Figure 3:
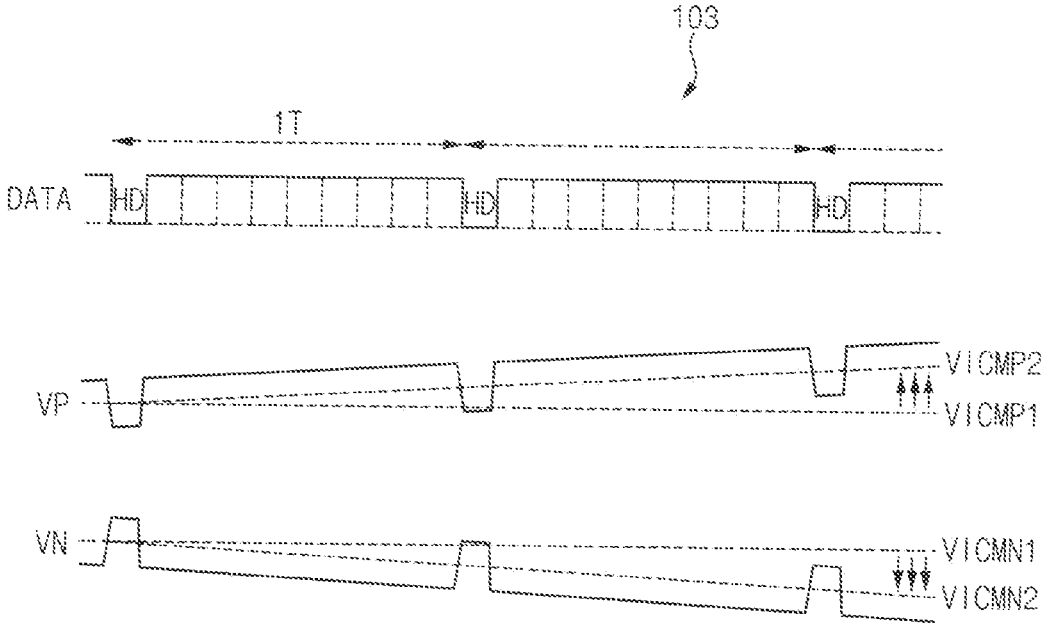
FIG. 3 is a conceptual diagram illustrating an input common mode voltage varied according to a data signal of the data transmission circuit of FIG. 2.
Figure 4:
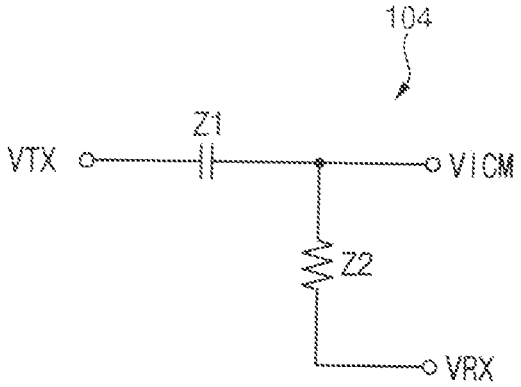
FIG. 4 is a circuit diagram illustrating a transmitting voltage, a receiving voltage and an input common mode voltage of the data transmission circuit of FIG. 2.

FIG. 3 is a conceptual diagram illustrating an input common mode voltage 103 varied according to the data signal DATA of the data transmission circuit 102 of FIG. 2. FIG. 4 is a circuit diagram illustrating a circuit 104 with a transmitting voltage VTX, a receiving voltage VRX and an input common mode voltage VICM of the data transmission circuit 102 of FIG. 2.

In FIG. 3, the data signal DATA is a digital signal. The data signal DATA has one of a high level and a low level. In FIG. 3, for example, the data signal DATA may include only the high level except for a head portion HD during one period 1T.

When the data signal DATA includes only the high level as shown in FIG. 3, the input common mode voltage VICM of a positive voltage VP transmitted through the first transmission line TL1 may gradually increase from an ideal first voltage level VCIMP1 to a second voltage level VICMP2 greater than the first voltage level VCIMP1

When the data signal DATA includes only the high level as shown in FIG. 3, the input common mode voltage VICM of a negative voltage VN transmitted through the second transmission line TL2 may gradually decrease from an ideal third voltage level VCIMN1 to a fourth voltage level VICMN2 less than the third voltage level VCIMN1.

When the input common mode voltage VICM exceeds an ideal level, the circuit of the receiver RX may be damaged or an error may occur in a received signal of the receiver RX.

As shown in FIG. 4, when VTX is a transmitting voltage of the transmitter 10, VRX is a receiving voltage of the receiver 20, Z1 is an impedance of an AC coupling capacitor and Z2 is an impedance of a termination resistor, the input common mode voltage VICM may be represented as in the following Equation 1.

$$VICM=(VTX-VRX)*(Z2/Z1+Z2) \quad \text{[Equation 1]}$$

When the impedance Z1 of the AC coupling capacitor is varied according to a frequency and a ratio between the high level and the low level of the data signal DATA. In addition, the input common mode voltage VICM is varied according to the ratio between the high level and the low level of the data signal DATA.

As shown in FIG. 3, when the ratio of the high level and the low level is not 1:1, the input common mode voltage VICM may increase or decrease from the ideal value.

In an embodiment, a display panel driver includes a driving controller (200); a data driver (500); a data transmission circuit (102, 104) connected between the driving controller and the data driver; a transmitter (10) of the data transmission circuit disposed in the driving controller; a receiver (20) of the data transmission circuit disposed in the data driver; a first transmission line (TL1) of the data transmission circuit disposed between the transmitter and the receiver; a second transmission line (TL2) of the data transmission circuit disposed between the transmitter and the receiver; a first transmitter voltage terminal (VTX) of the first transmission line disposed in the transmitter; a first receiver voltage terminal (VRX) of the first transmission line disposed in the receiver; a first capacitor (Z1, C1) and a first resistor (Z2) connected in series between the first transmitter voltage terminal and the first receiver voltage terminal; a first input common mode voltage terminal (VICM, VICMP1) disposed between the first capacitor and the first resistor; a second transmitter voltage terminal (VTX) of the second transmission line disposed in the transmitter; a second receiver voltage terminal (VRX) of the second transmission line disposed in the receiver; a second capacitor (Z1, C3) and a second resistor (Z2) connected in series between the second transmitter voltage terminal and the second receiver voltage terminal; and a second input common mode voltage terminal (VICM, VICMN1) disposed between the second capacitor and the second resistor.

In an embodiment, the display panel driver further includes a third capacitor (Z1, C2) connected between the first resistor and the first receiver voltage terminal; a third input common mode voltage terminal (VICM, VICMP2) disposed between the first resistor and the third capacitor; a fourth capacitor (Z1, C4) connected between the second resistor and the second receiver voltage terminal; and a fourth input common mode voltage terminal (VICM, VICMN2) disposed between the second resistor and the fourth capacitor.

In an embodiment, the display panel driver further includes a third resistor (Z2) disposed between the third capacitor and the first receiver voltage terminal; and a fourth resistor (Z2) disposed between the fourth capacitor and the second receiver voltage terminal.

In an embodiment of the display panel driver, the driving controller (200) and the data driver (500) integrally form a timing controller embedded data driver (TED).

In an embodiment of the display panel driver, at least one of the first capacitor (Z1, C1), the second capacitor (Z1, C3), the first resistor (Z2), or the second resistor (Z2) has a variable impedance.

Figure 5:
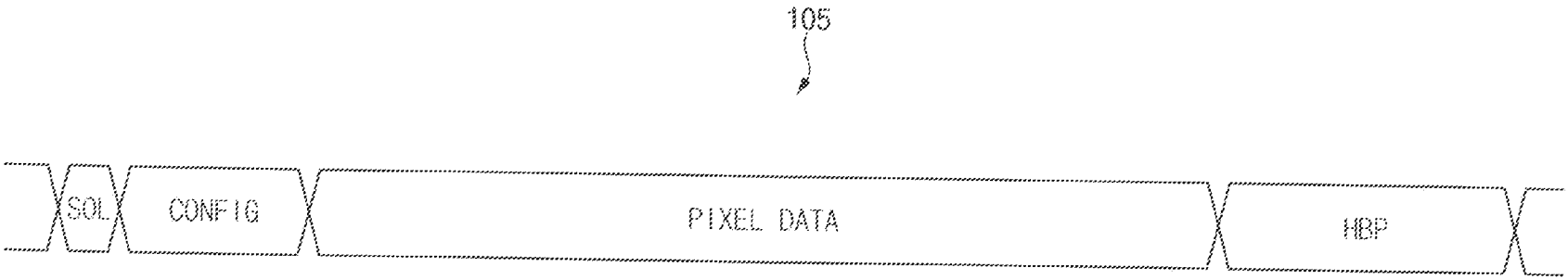
FIG. 5 is a conceptual diagram illustrating a first signal transmitted through the data transmission circuit of FIG. 2.

FIG. 5 is a conceptual diagram illustrating a first signal 105 transmitted through the data transmission circuit 102 of FIG. 2.

Referring to FIGS. 1 to 5, the data signal DATA transmitted by the data transmission circuit includes a line start signal SOL, a configuration signal CONFIG, a pixel signal PIXEL DATA and a horizontal blank signal HBP. The line start signal SOL represents a start of a horizontal line data of the display panel 100. The configuration signal CONFIG represents a configuration value corresponding to a horizontal line. The pixel signal PIXEL DATA represents pixel data corresponding to the horizontal line. The horizontal blank signal HBP represents a blank of the horizontal line.

A ratio between the high level and the low level in the pixel signal PIXEL DATA may be 1:1 by a scramble method. In addition, the vertical blank signal HBP may have a data pattern of the ratio between the high level and the low level of 1:1.

As explained with reference to FIG. 3, when the ratio between the high level and the low level of the line start signal SOL or the configuration signal CONFIG is not 1:1 and the line start signal SOL or the configuration signal CONFIG is transmitted by the data transmission circuit, the input common mode voltage VICM may increase or decrease from the ideal value so that the receiver 20 might be damaged or the error might occur in the received signal of the receiver 20.

Figure 6:
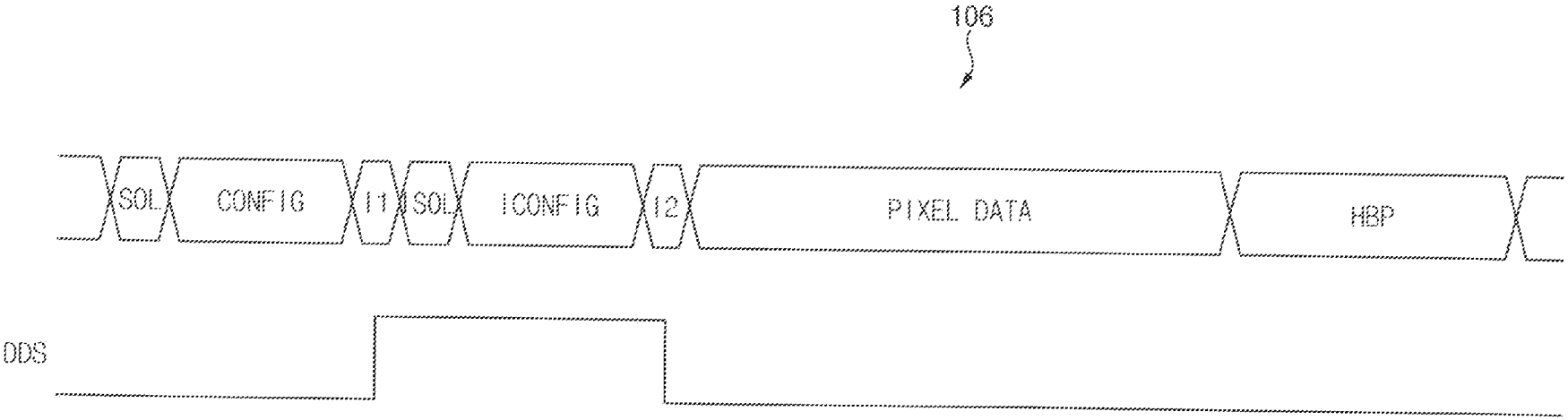
FIG. 6 is a conceptual diagram illustrating a second signal transmitted through the data transmission circuit of FIG. 2.
Figure 7:
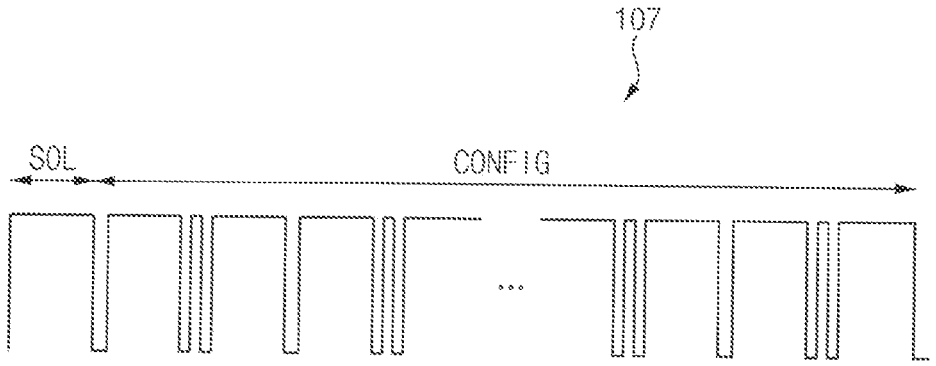
FIG. 7 is a conceptual diagram illustrating examples of a line start signal and a configuration signal of the second signal of FIG. 6.
Figure 8:
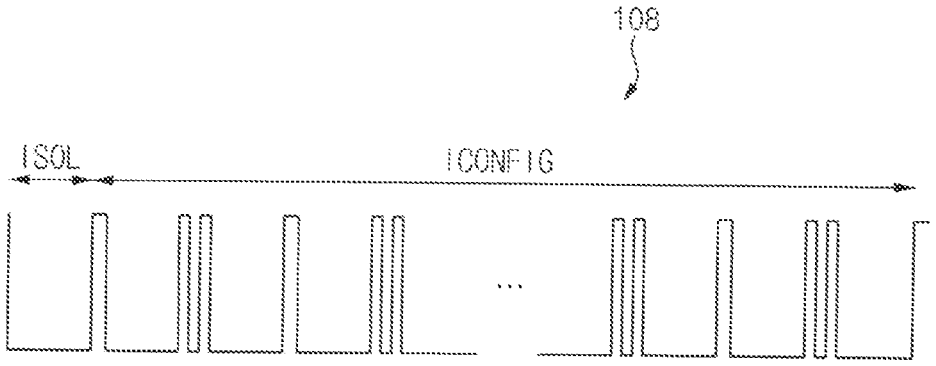
FIG. 8 is a conceptual diagram illustrating examples of an inverted line start signal and an inverted configuration signal of the second signal of FIG. 6.

FIG. 6 is a conceptual diagram illustrating a second signal 106 transmitted through the data transmission circuit 102 of FIG. 2. FIG. 7 is a conceptual diagram illustrating examples 107 of a line start signal and a configuration signal of the second signal 106 of FIG. 6. FIG. 8 is a conceptual diagram illustrating examples 108 of an inverted line start signal and an inverted configuration signal of the second signal 106 of FIG. 6.

Referring to FIG. 6, the data signal DATA of the present embodiment may include at least one of an inverted line start signal ISOL which is an inverted version of the line start signal SOL and an inverted configuration signal ICONFIG which is an inverted version of the configuration signal CONFIG. Although both the inverted line start signal ISOL and the inverted configuration signal ICONFIG are illustrated in FIG. 6, one of the inverted line start signal ISOL and the inverted configuration signal ICONFIG are selectively included in the data signal DATA.

In FIG. 7, for example, a high level ratio of the line start signal SOL and the configuration signal CONFIG may be extremely greater than a low level ratio of the line start signal SOL and the configuration signal CONFIG. When the high level ratio is extremely greater than the low level ratio in the line start signal SOL and the configuration signal CONFIG as shown in FIG. 7, the positive voltage VP of the input common mode voltage VICM may increase much greater than the ideal level and the negative voltage VN of the input common mode voltage VICM may decrease much less than the ideal level as explained with reference to FIG. 3.

FIG. 8 illustrates the inverted line start signal ISOL which is the inverted version of the start line signal SOL and the inverted configuration ICONFIG which is the inverted version of the configuration signal CONFIG. The inverted line start signal ISOL and the inverted configuration ICONFIG in FIG. 8 are inverted versions of the line start signal ISOL and the configuration CONFIG in FIG. 7, respectively, so that the low level ratio of the inverted line start signal ISOL and the inverted configuration signal ICONFIG may be significantly greater than the high level ratio of the inverted line start signal ISOL and the inverted configuration signal ICONFIG.

In FIG. 6, the data signal DATA may sequentially include the line start signal SOL, the configuration signal CONFIG, a first inversion signal I1 that indicates a transition from non-inverted signals to inverted signals, the inverted line start signal ISOL, the inverted configuration signal ICONFIG, and a second inversion signal I2 that indicates a transition from inverted signals to non-inverted signals.

The data signal DATA includes all of the line start signal SOL, the configuration signal CONFIG, the inverted line start signal ISOL and the inverted configuration signal ICONFIG so that the ratio of the high level and the low level may be 1:1 with respect to all of the line start signal SOL, the configuration signal CONFIG, the inverted line start signal ISOL and the inverted configuration signal ICONFIG.

As a result, when the data signal DATA is transmitted by the data transmission circuit, the input common mode voltage VICM need not increase or decrease from the ideal value so that the receiver 20 need not be damaged and the error need not occur in the received signal of the receiver 20.

The first inversion signal I1 and the second inversion signal I2 are inserted before and after the inverted line start signal ISOL and the inverted configuration signal ICONFIG so that positions of the inverted line start signal ISOL and the inverted configuration signal ICONFIG may be provided to the receiver 20. The inverted line start signal ISOL and the inverted configuration signal ICONFIG are signals only for adjusting the ratio between the high level and the low level of the data signal DATA. The inverted line start signal ISOL and the inverted configuration signal ICONFIG do not include information necessary for the receiver 20 so that the inverted line start signal ISOL and the inverted configuration signal ICONFIG may be dummy signals.

In addition, the transmitter 10 may further transmit an inversion detection signal DDS to the receiver 20. The inversion detection signal DDS may be changed from a first level (e.g., a low level) to a second level (e.g., a high level) overlapping with the first inversion signal I1 and may be changed from the second level to the first level overlapping with the second inversion signal I2.

The receiver 20 may recognize the change of the level of the inversion detection signal DDS in a signal pattern of the first inversion signal I1 so that the receiver 20 may recognize a start of the dummy signal. In addition, the receiver 20 may recognize the change of the level of the inversion detection signal DDS in a signal pattern of the second inversion signal I2 so that the receiver 20 may recognize an end of the dummy signal.

For example, the first inversion signal I1 and the second inversion signal I2 may include a signal pattern substantially the same as the horizontal blank signal HBP. When the level of the inversion detection signal DDS is not changed in the signal pattern of the horizontal blank signal HBP, the receiver 20 may recognize the horizontal blank signal HBP. In contrast, as explained above, when the level of the inversion detection signal DDS is changed in the signal pattern of the horizontal blank signal HBP, the receiver 20 may recognize the start of the dummy signal and the end of the dummy signal.

Although the data signal DATA includes both the inverted line start signal ISOL and the inverted configuration signal ICONFIG in FIG. 6, the present inventive concept need not be limited thereto.

The data signal DATA may selectively include one of the inverted line start signal ISOL and the inverted configuration signal ICONFIG according to the data patterns of the line start signal SOL and the configuration signal CONFIG.

For example, when the ratio between the high level and the low level of the line start signal SOL is not 1:1, the data signal DATA may include the inverted line start signal ISOL so that the change of the input common mode voltage VICM due to the line start signal SOL may be compensated.

For example, when the ratio between the high level and the low level of the configuration signal CONFIG is not 1:1, the data signal DATA may include the inverted configuration signal ICONFIG so that the change of the input common mode voltage VICM due to the configuration signal CONFIG may be compensated.

According to the present embodiment, the inverted version of at least one of the line start signal SOL and the configuration signal CONFIG may be inserted so that the ratio between the high signal and the low signal of the data signal DATA transmitted by the data transmission circuit may be actively controlled. Thus, the input common mode voltage VICM of the data transmission circuit may be maintained in a target range.

Since the input common mode voltage VICM is maintained in the target range, the circuit of the receiver 20 need not be damaged and the error need not occur in the signal received from the receiver 20 so that the signal transmitting quality need not deteriorate.

Therefore, the stability and the reliability of the data transmission circuit and the display apparatus may be enhanced.

Figure 9:
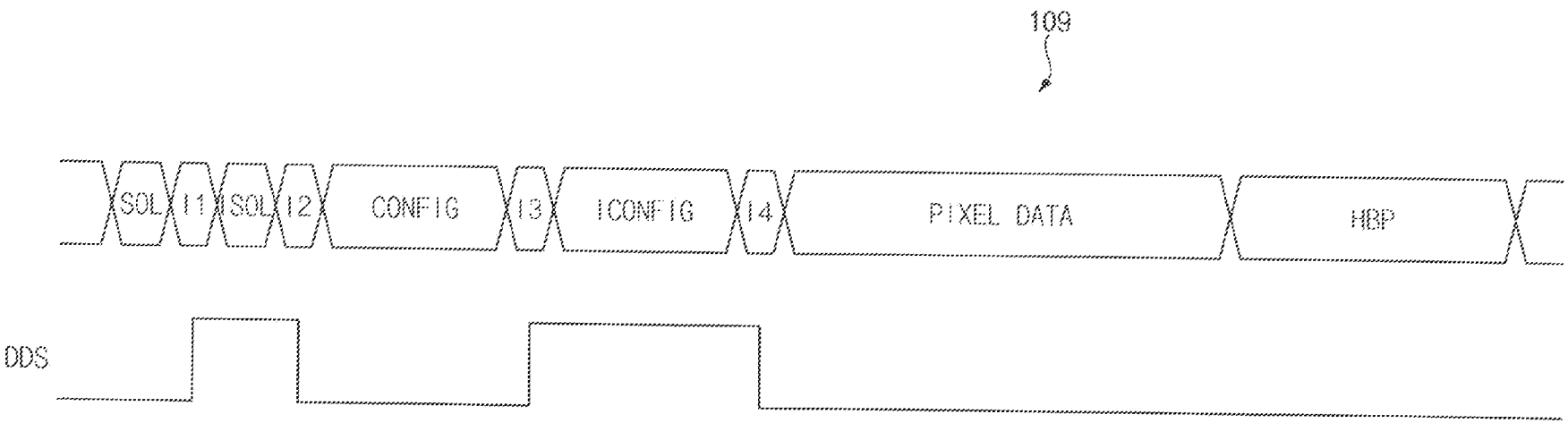
FIG. 9 is a conceptual diagram illustrating a third signal transmitted through a data transmission circuit of a display apparatus according to an embodiment of the present inventive concept.

FIG. 9 is a conceptual diagram illustrating a third signal 109 transmitted through a data transmission circuit of a display apparatus according to an embodiment of the present inventive concept.

The data transmission circuit and the display apparatus according to the present embodiment is substantially the same as the data transmission circuit and the display apparatus of the previous embodiment explained with reference to FIGS. 1 to 8 except for the structure of the data signal. Thus, the same reference numerals will be used to refer to the same or like parts as those described in the previous embodiment of FIGS. 1 to 8 and any repetitive explanation concerning the above elements may be omitted.

Referring to FIGS. 1 to 5 and 7 to 9, the display apparatus includes the data transmission circuit. The data transmission circuit includes a transmitter (TX) 10 transmitting the data signal DATA and a receiver (RX) 20 receiving the data signal DATA.

For example, the transmitter 10 may be included in the driving controller 200. The receiver 20 may be included in the data driver 500.

The data transmission circuit includes a first transmission line TL1 connected between the transmitter 10 and the receiver 20 and a second transmission line TL2 connected between the transmitter 10 and the receiver 20. For example, the first transmission line TL1 and the second transmission line TL2 may transmit the data signal DATA in a differential mode. The first transmission line TL1 may be a positive signal transmitting line. The second transmission line TL2 may be a negative signal transmitting line.

The data signal DATA of the present embodiment may include at least one of an inverted line start signal ISOL which is an inverted version of the line start signal SOL and an inverted configuration signal ICONFIG which is an inverted version of the configuration signal CONFIG.

In FIG. 9, the data signal DATA may sequentially include the line start signal SOL, a first inversion signal I1 that indicates a transition from non-inverted signals to inverted signals, the inverted line start signal ISOL, a second inversion signal I2 that indicates a transition from inverted signals to non-inverted signals, the configuration signal CONFIG, a third inversion signal I3 that indicates a transition from non-inverted signals to inverted signals, the inverted configuration signal ICONFIG and a fourth inversion signal I4 that indicates a transition from inverted signals to non-inverted signals.

The data signal DATA includes all of the line start signal SOL, the configuration signal CONFIG, the inverted line start signal ISOL and the inverted configuration signal ICONFIG so that the ratio of the high level and the low level may be 1:1 with respect to all of the line start signal SOL, the configuration signal CONFIG, the inverted line start signal ISOL and the inverted configuration signal ICONFIG.

In the present embodiment, the inverted line start signal ISOL is disposed after the line start signal SOL and the inverted configuration signal ICONFIG is disposed after the configuration signal CONFIG. Thus, when the input common mode voltage VICM is changed due to the line start signal SOL, the change of the input common mode voltage VICM may be immediately compensated by the inverted line start signal ISOL. In addition, when the input common mode voltage VICM is changed due to the configuration signal CONFIG, the change of the input common mode voltage VICM may be immediately compensated by the inverted configuration signal ICONFIG. Therefore, the change of the input common mode voltage VICM may be more effectively compensated compared to the embodiment of FIG. 6.

The first inversion signal I1 and the second inversion signal I2 are inserted before and after the inverted line start signal ISOL so that a position of the inverted line start signal ISOL may be provided to the receiver 20. In addition, the third inversion signal I3 and the fourth inversion signal I4 are inserted before and after the inverted configuration signal ICONFIG so that a position of inverted configuration signal ICONFIG may be provided to the receiver 20.

In addition, the transmitter 10 may further transmit an inversion detection signal DDS to the receiver 20. The inversion detection signal DDS may be changed from a first level to a second level overlapping with the first inversion signal I1, may be changed from the second level to the first level overlapping with the second inversion signal I2, may be changed from the first level to the second level overlapping with the third inversion signal I3 and may be changed from the second level to the first level overlapping with the fourth inversion signal I4.

The receiver 20 may recognize the dummy signal (such as the inverted line start signal ISOL and the inverted configuration signal ICONFIG) using the first to fourth inversion signals I1 to I4 and the inversion detection signal DDS. For example, the first to fourth inversion signals I1 to I4 may include a signal pattern substantially the same as the horizontal blank signal HBP.

According to the present embodiment, the inverted version of at least one of the line start signal SOL and the configuration signal CONFIG may be inserted so that the ratio between the high signal and the low signal of the data signal DATA transmitted by the data transmission circuit may be actively controlled. Thus, the input common mode voltage VICM of the data transmission circuit may be maintained in a target range.

Since the input common mode voltage VICM is maintained in the target range, the circuit of the receiver 20 need not be damaged, the error need not occur in the signal received from the receiver 20, and the signal transmitting quality need not deteriorate.

Therefore, the stability and the reliability of the data transmission circuit and the display apparatus may be enhanced.

Figure 10:
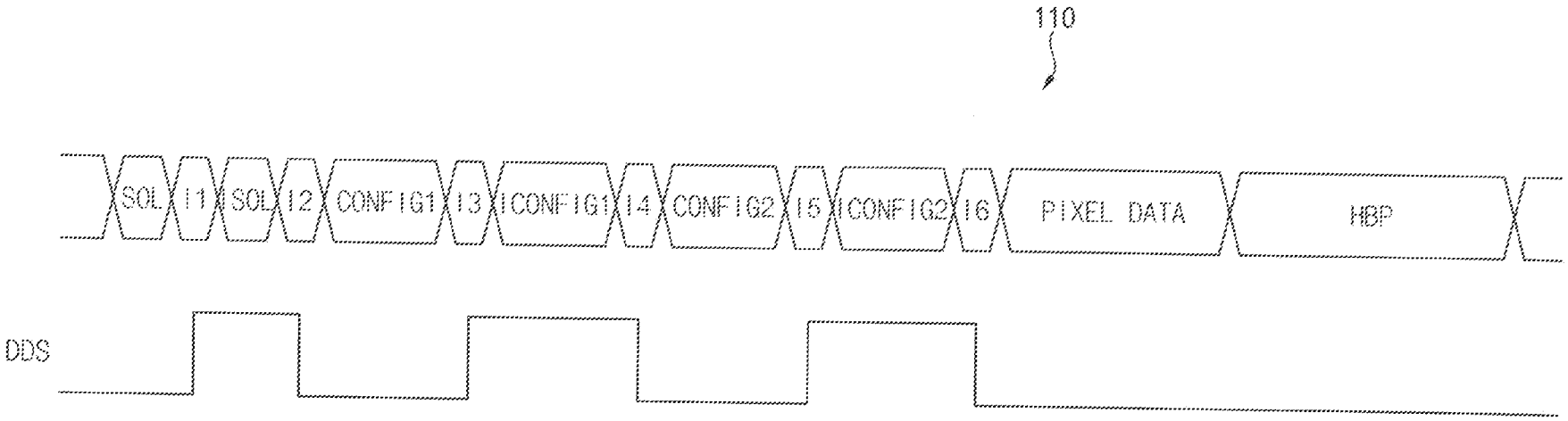
FIG. 10 is a conceptual diagram illustrating a fourth signal transmitted through a data transmission circuit of a display apparatus according to an embodiment of the present inventive concept.

FIG. 10 is a conceptual diagram illustrating a fourth signal 110 transmitted through a data transmission circuit of a display apparatus according to an embodiment of the present inventive concept.

The data transmission circuit and the display apparatus according to the present embodiment is substantially the same as the data transmission circuit and the display apparatus of the previous embodiment explained with reference to FIGS. 1 to 8 except for the structure of the data signal. Thus, the same reference numerals will be used to refer to the same or like parts as those described in the previous embodiment of FIGS. 1 to 8 and any repetitive explanation concerning the above elements may be omitted.

Referring to FIGS. 1 to 5, 7, 8 and 10, the display apparatus includes the data transmission circuit. The data transmission circuit includes a transmitter (TX) 10 transmitting the data signal DATA and a receiver (RX) 20 receiving the data signal DATA.

For example, the transmitter 10 may be included in the driving controller 200. The receiver 20 may be included in the data driver 500.

The data transmission circuit includes a first transmission line TL1 connected between the transmitter 10 and the receiver 20 and a second transmission line TL2 connected between the transmitter 10 and the receiver 20. For example, the first transmission line TL1 and the second transmission line TL2 may transmit the data signal DATA in a differential mode. The first transmission line TL1 may be a positive signal transmitting line. The second transmission line TL2 may be a negative signal transmitting line.

The data signal DATA of the present embodiment may include at least one of an inverted line start signal ISOL which is an inverted version of the line start signal SOL and an inverted configuration signal which is an inverted version of the configuration signal.

In FIG. 10, the configuration signal may include a first configuration signal CONFIG. 1 and a second configuration signal CONFIG. 2 and the inverted configuration signal may include a first inverted configuration signal ICONFIG. 1 which is an inverted version of the first configuration signal CONFIG. 1 and a second inverted configuration signal ICONFIG. 2 which is an inverted version of the second configuration signal CONFIG. 2.

The data signal DATA may sequentially include the line start signal SOL, a first inversion signal I1 that indicates a transition from non-inverted signals to inverted signals, the inverted line start signal ISOL, a second inversion signal I2 that indicates a transition from inverted signals to non-inverted signals, the first configuration signal CONFIG. 1, a third inversion signal I3 that indicates a transition from non-inverted signals to inverted signals, the first inverted configuration signal ICONFIG. 1, a fourth inversion signal I4 that indicates a transition from inverted signals to non-inverted signals, the second configuration signal CONFIG. 2, a fifth inversion signal I5 that indicates a transition from non-inverted signals to inverted signals, the second inverted configuration signal ICONFIG. 2 and a sixth inversion signal I6 that indicates a transition from inverted signals to non-inverted signals.

The data signal DATA includes all of the line start signal SOL, the first and second configuration signals CONFIG. 1 and CONFIG. 2, the inverted line start signal ISOL and the first and second inverted configuration signals ICONFIG. 1 and ICONFIG. 2 so that the ratio of the high level and the low level may be 1:1 with respect to all of the line start signal SOL, the first and second configuration signals CONFIG. 1 and CONFIG. 2, the inverted line start signal ISOL and the first and second inverted configuration signals ICONFIG. 1 and ICONFIG. 2.

In the present embodiment, the inverted line start signal ISOL is disposed after the line start signal SOL, the first inverted configuration signal ICONFIG. 1 is disposed after the first configuration signal CONFIG. 1 and the second inverted configuration signal ICONFIG. 2 is disposed after the second configuration signal CONFIG. 2. Thus, when the input common mode voltage VICM is changed due to the line start signal SOL, the change of the input common mode voltage VICM may be immediately compensated by the inverted line start signal ISOL. In addition, when the input common mode voltage VICM is changed due to the first configuration signal CONFIG. 1, the change of the input common mode voltage VICM may be immediately compensated by the first inverted configuration signal ICONFIG. 1. In addition, when the input common mode voltage VICM is changed due to the second configuration signal CONFIG. 2, the change of the input common mode voltage VICM may be immediately compensated by the second inverted configuration signal ICONFIG. 2. Therefore, the change of the input common mode voltage VICM may be more effectively compensated compared to the embodiments of FIGS. 6 and 9.

The first inversion signal I1 and the second inversion signal I2 are inserted before and after the inverted line start signal ISOL so that a position of the inverted line start signal ISOL may be provided to the receiver 20. In addition, the third inversion signal I3 and the fourth inversion signal I4 are inserted before and after the first inverted configuration signal ICONFIG so that a position of first inverted configuration signal ICONFIG. 1 may be provided to the receiver 20. In addition, the fifth inversion signal I5 and the sixth inversion signal I6 are inserted before and after the second inverted configuration signal ICONFIG. 2 so that a position of second inverted configuration signal ICONFIG. 2 may be provided to the receiver 20.

In addition, the transmitter 10 may further transmit an inversion detection signal DDS to the receiver 20. The inversion detection signal DDS may be changed from a first level to a second level overlapping with the first inversion signal I1, may be changed from the second level to the first level overlapping with the second inversion signal I2, may be changed from the first level to the second level overlapping with the third inversion signal I3, may be changed from the second level to the first level overlapping with the fourth inversion signal I4, may be changed from the first level to the second level overlapping with the fifth inversion signal I5 and may be changed from the second level to the first level overlapping with the sixth inversion signal I6.

The receiver 20 may recognize the dummy signal (the inverted line start signal ISOL, the first and second inverted configuration signals ICONFIG. 1 and ICONFIG. 2) using the first to sixth inversion signals I1 to I6 and the inversion detection signal DDS. For example, the first to sixth inversion signals I1 to I6 may include a signal pattern substantially the same as the horizontal blank signal HBP.

According to the present embodiment, the inverted version of at least one of the line start signal SOL and the first and second configuration signals CONFIG. 1 and CONFIG. 2 may be inserted so that the ratio between the high signal and the low signal of the data signal DATA transmitted by the data transmission circuit may be actively controlled. Thus, the input common mode voltage VICM of the data transmission circuit may be maintained in a target range.

Since the input common mode voltage VICM is maintained in the target range, the circuit of the receiver 20 need not be damaged, the error need not occur in the signal received from the receiver 20, and the signal transmitting quality need not deteriorate.

Therefore, the stability and the reliability of the data transmission circuit and the display apparatus may be enhanced.

Figure 11:
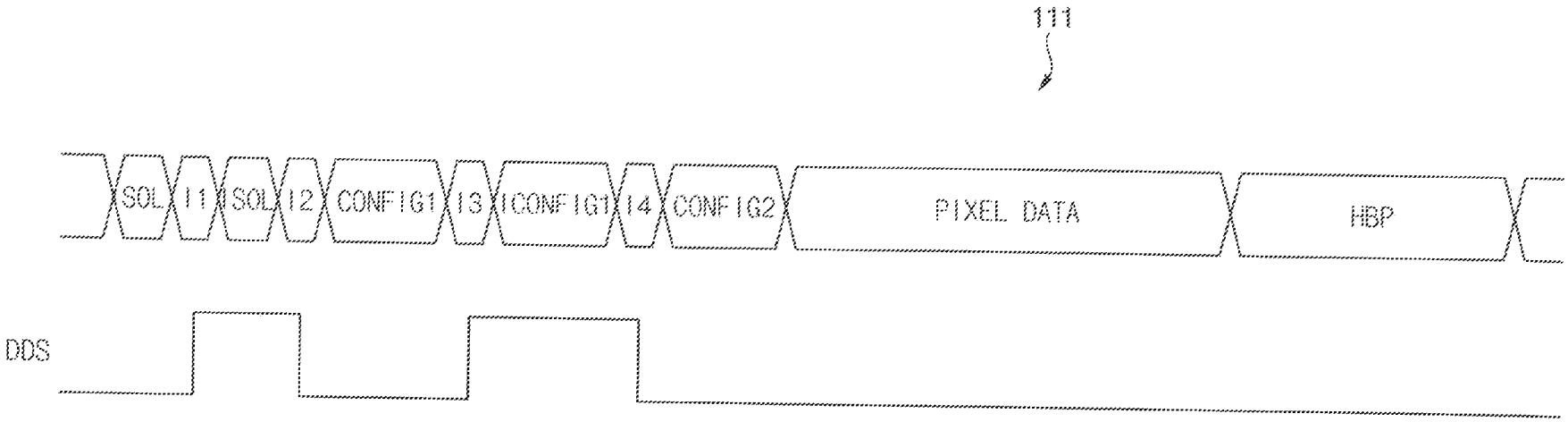
FIG. 11 is a conceptual diagram illustrating a fifth signal transmitted through a data transmission circuit of a display apparatus according to an embodiment of the present inventive concept.

FIG. 11 is a conceptual diagram illustrating a fifth signal 111 transmitted through a data transmission circuit of a display apparatus according to an embodiment of the present inventive concept.

In FIG. 11, the first inverted configuration signal ICONFIG. 1 and the second inverted configuration signal ICONFIG. 2 may be selectively inserted.

Referring to FIGS. 10 and 11, the configuration signal may include a first configuration signal CONFIG. 1 and a second configuration signal CONFIG. 2. The data signal may selectively include one of the first inverted configuration signal ICONFIG. 1 which is the inverted version of the first configuration signal CONFIG. 1 and the second inverted configuration signal ICONFIG. 2 which is the inverted version of the second configuration signal CONFIG. 2.

For example, when the ratio between the high level and the low level of the first configuration signal CONFIG. 1 is not 1:1, the data signal DATA may sequentially include the line start signal SOL, a first inversion signal I1, the inverted line start signal ISOL, a second inversion signal I2, the first configuration signal CONFIG. 1, a third inversion signal I3, the first inverted configuration signal ICONFIG. 1, a fourth inversion signal I4 and the second configuration signal CONFIG. 2. Herein, when the ratio between the high level and the low level of the second configuration signal CONFIG. 2 is 1:1, the data signal DATA need not include the second inverted configuration signal ICONFIG. 2.

For example, when the ratio between the high level and the low level of the second configuration signal CONFIG. 2 is not 1:1, the data signal DATA may sequentially include the line start signal SOL, the first inversion signal I1, the inverted line start signal ISOL, the second inversion signal I2, the first configuration signal CONFIG. 1, the second configuration signal CONFIG. 2, a third inversion signal (I5 in FIG. 10), the second inverted configuration signal ICONFIG. 2 and a fourth inversion signal (I6 in FIG. 10). Herein, when the ratio between the high level and the low level of the first configuration signal CONFIG. 1 is 1:1, the data signal DATA need not include the first inverted configuration signal ICONFIG. 1.

According to the present embodiment, the inverted version of at least one of the line start signal SOL and the first and second configuration signals CONFIG. 1 and CONFIG. 2 may be inserted so that the ratio between the high signal and the low signal of the data signal DATA transmitted by the data transmission circuit may be actively controlled. Thus, the input common mode voltage VICM of the data transmission circuit may be maintained in a target range.

Since the input common mode voltage VICM is maintained in the target range, the circuit of the receiver 20 need not be damaged, the error need not occur in the signal received from the receiver 20, and the signal transmitting quality need not deteriorate.

Therefore, the stability and the reliability of the data transmission circuit and the display apparatus may be enhanced.

According to the present embodiment, the inverted version of at least one of the line start signal and the configuration signal may be inserted into the data signal so that the input common mode voltage may be stabilized.

The foregoing is illustrative of the present inventive concept and is not to be construed as limiting thereof. Although embodiments of the present inventive concept have been described, those of ordinary skill in the pertinent art will readily appreciate that many modifications are possible in the embodiments without materially departing from the teachings of the present disclosure. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific embodiments disclosed, and that modifications to the disclosed embodiments, as well as other embodiments, are intended to be included within the scope of the appended claims. The present inventive concept is defined by the following claims, with equivalents to be included therein.

What is claimed is:

1. A data transmission circuit comprising:
a transmitter configured to transmit a data signal;
a receiver configured to receive the data signal;
a first transmission line connected between the transmitter and the receiver; and
a second transmission line connected between the transmitter and the receiver,
wherein the data signal includes a line start signal, and a configuration signal, and
wherein the data signal further includes at least one of an inverted line start signal which is an inverted version of the line start signal or an inverted configuration signal which is an inverted version of the configuration signal,
wherein the data signal sequentially includes the line start signal, the configuration signal, a first inversion signal, the inverted line start signal, the inverted configuration signal, and a second inversion signal.

2. The data transmission circuit of claim 1,
wherein the transmitter is configured to further transmit an inversion detection signal to the receiver, and
wherein the inversion detection signal is changed from a first level to a second level overlapping with the first inversion signal and changed from the second level to the first level overlapping with the second inversion signal.

3. The data transmission circuit of claim 1,
wherein the data signal further includes a pixel signal and a horizontal blank signal,
wherein the first inversion signal and the second inversion signal include a signal pattern substantially the same as the horizontal blank signal.

4. The data transmission circuit of claim 1, wherein the data signal includes one of the inverted line start signal or the inverted configuration signal according to data patterns of the line start signal or the configuration signal, respectively.

5. The data transmission circuit of claim 4, wherein when a ratio between a high level and a low level of the line start signal is not 1:1, the data signal includes the inverted line start signal.

6. The data transmission circuit of claim 4, wherein when a ratio between a high level and a low level of the configuration signal is not 1:1, the data signal includes the inverted configuration signal.

7. The data transmission circuit of claim 1,
wherein the configuration signal includes a first configuration signal and a second configuration signal, and
wherein the data signal includes one of a first inverted configuration signal which is an inverted version of the first configuration signal or a second inverted configuration signal which is an inverted version of the second configuration signal according to data patterns of the first configuration signal or the second configuration signal, respectively.

8. The data transmission circuit of claim 7, wherein when a ratio between a high level and a low level of the first configuration signal is not 1:1, the data signal sequentially includes the line start signal, a first inversion signal, the inverted line start signal, a second inversion signal, the first configuration signal, a third inversion signal, the first inverted configuration signal, a fourth inversion signal, and the second configuration signal.

9. The data transmission circuit of claim 7, wherein when a ratio between a high level and a low level of the second configuration signal is not 1:1, the data signal sequentially includes the line start signal, a first inversion signal, the inverted line start signal, a second inversion signal, the first configuration signal, the second configuration signal, a third inversion signal, the second inverted configuration signal, and a fourth inversion signal.

10. The data transmission circuit of claim 1, further comprising:
a first capacitor disposed between the transmitter and the first transmission line;
a second capacitor disposed between the receiver and the first transmission line;
a third capacitor disposed between the transmitter and the second transmission line; and
a fourth capacitor disposed between the receiver and the second transmission line.

11. A data transmission circuit comprising:
a transmitter configured to transmit a data signal;
a receiver configured to receive the data signal;
a first transmission line connected between the transmitter and the receiver; and
a second transmission line connected between the transmitter and the receiver,
wherein the data signal includes a line start signal, and a configuration signal,
wherein the data signal further includes at least one of an inverted line start signal which is an inverted version of the line start signal or an inverted configuration signal which is an inverted version of the configuration signal, wherein the data signal sequentially includes the line start signal, a first inversion signal, the inverted line start signal, a second inversion signal, the configuration signal, a third inversion signal, the inverted configuration signal, and a fourth inversion signal.

12. The data transmission circuit of claim 11, wherein the transmitter is configured to further transmit an inversion detection signal to the receiver, and wherein the inversion detection signal is changed from a first level to a second level overlapping with the first inversion signal, changed from the second level to the first level overlapping with the second inversion signal, changed from the first level to the second level overlapping with the third inversion signal, and changed from the second level to the first level overlapping with the fourth inversion signal.

13. The data transmission circuit of claim 11, wherein the data signal further includes a pixel signal and a horizontal blank signal, wherein the first inversion signal, the second inversion signal, the third inversion signal, and the fourth inversion signal include a signal pattern substantially the same as the horizontal blank signal.

14. The data transmission circuit of claim 11, wherein the configuration signal includes a first configuration signal and a second configuration signal, wherein the inverted configuration signal includes a first inverted configuration signal which is an inverted version of the first configuration signal, and a second inverted configuration signal which is an inverted version of the second configuration signal, and wherein the data signal further sequentially includes after the fourth inversion signal, the second configuration signal, a fifth inversion signal, the second inverted configuration signal, and a sixth inversion signal.

15. The data transmission circuit of claim 14, wherein the transmitter is configured to further transmit an inversion detection signal to the receiver, and wherein the inversion detection signal is changed from a first level to a second level overlapping with the first inversion signal, changed from the second level to the first level overlapping with the second inversion signal, changed from the first level to the second level overlapping with the third inversion signal, changed from the second level to the first level overlapping with the fourth inversion signal, changed from the first level to the second level overlapping with the fifth inversion signal, and changed from the second level to the first level overlapping with the sixth inversion signal.

16. The data transmission circuit of claim 14, wherein the data signal further includes a pixel signal and a horizontal blank signal, wherein the first inversion signal, the second inversion signal, the third inversion signal, the fourth inversion signal, the fifth inversion signal and the sixth inversion signal include a signal pattern substantially the same as the horizontal blank signal.

17. A display apparatus comprising:

a display panel configured to display an image based on data signal;

a driving controller configured to generate the data signal based on input image data;

a data driver configured to convert the data signal into a data voltage and output the data voltage to the display panel; and a data transmission circuit including a transmitter configured to transmit a signal, a receiver configured to receive the signal, a first transmission line connected between the transmitter and the receiver, and a second transmission line connected between the transmitter and the receiver, wherein the data signal includes a line start signal, a configuration signal, a pixel signal, and a horizontal blank signal, and wherein the data signal further includes at least one of an inverted line start signal which is an inverted version of the line start signal or an inverted configuration signal which is an inverted version of the configuration signal, wherein the data signal sequentially includes the line start signal, the configuration signal, a first inversion signal, the inverted line start signal, the inverted configuration signal, and a second inversion signal.

18. The display apparatus of claim 17, wherein the transmitter is configured to further transmit an inversion detection signal to the receiver, and wherein the inversion detection signal is changed from a first level to a second level overlapping with the first inversion signal, and changed from the second level to the first level overlapping with the second inversion signal.

19. The display apparatus of claim 17, wherein the data signal further sequentially includes a third inversion signal between the line start signal and the configuration signal, and a fourth inversion signal between the inverted line start signal and the inverted configuration signal.

20. The display apparatus of claim 19, wherein the data signal further sequentially includes after the second inversion signal, a second configuration signal, a fifth inversion signal, a second inverted configuration signal, and a sixth inversion signal.

* * * * *